US011554930B2

(12) United States Patent
Kim et al.

(10) Patent No.: US 11,554,930 B2
(45) Date of Patent: Jan. 17, 2023

(54) APPARATUS FOR MANUFCTURING GUITAR STRING

(71) Applicant: Ohrey Kim, Incheon (KR)

(72) Inventors: Ohrey Kim, Incheon (KR); Yun Ki Bang, Incheon (KR)

(73) Assignee: Ohrey Kim, Incheon (KR)

( * ) Notice: Subject to any disclaimer, the term of this patent is extended or adjusted under 35 U.S.C. 154(b) by 0 days.

(21) Appl. No.: 17/831,167

(22) Filed: Jun. 2, 2022

(65) Prior Publication Data

US 2022/0388806 A1 Dec. 8, 2022

(30) Foreign Application Priority Data

Jun. 4, 2021 (KR) ..... 10-2021-0072674

(51) Int. Cl.

| | |
|---|---|
| ***B65H 59/38*** | (2006.01) |
| ***B65H 57/00*** | (2006.01) |
| ***D07B 7/14*** | (2006.01) |
| ***B21F 7/00*** | (2006.01) |
| ***D02G 3/38*** | (2006.01) |
| *G10D 3/10* | (2006.01) |

(52) U.S. Cl.

CPC ..... *B65H 59/387* (2013.01); *B21F 7/00* (2013.01); *B65H 57/006* (2013.01); *D07B 7/14* (2013.01); *D02G 3/38* (2013.01); *G10D 3/10* (2013.01)

(58) Field of Classification Search

CPC ..... D07B 7/14; D02G 3/38; B65H 59/387; B21F 7/00

USPC ..... 57/11, 212

See application file for complete search history.

(56) References Cited

U.S. PATENT DOCUMENTS

| | | | | |
|---|---|---|---|---|
| 154,342 | A * | 8/1874 | Reinwarth | D07B 7/14 57/11 |
| 830,695 | A * | 9/1906 | Witzenmann | B21D 26/033 29/445 |
| 1,230,008 | A * | 6/1917 | Mirfield et al. | D07B 7/14 57/11 |
| 2,460,478 | A * | 2/1949 | Warner | A01K 91/00 242/441.2 |
| 2,989,255 | A * | 6/1961 | Smith, Jr. | B65H 81/08 57/11 |
| 8,234,851 | B2 * | 8/2012 | Wright | A44C 27/001 57/10 |

(Continued)

FOREIGN PATENT DOCUMENTS

| | | |
|---|---|---|
| CN | 201289732 Y | 8/2009 |
| KR | 10-2129188 B1 | 7/2020 |

*Primary Examiner* — Shaun R Hurley

(74) *Attorney, Agent, or Firm* — Novick, Kim & Lee PLLC; Jae Youn Kim

(57) ABSTRACT

An apparatus for manufacturing a guitar string includes a table part; a holding part holds both ends of a first wire so that the first wire is rotatable; a winding part which is movable in a direction in which the first wire is extended, so that the winding part sequentially winds a second wire around on the outer surface of the first wire being rotated; and a supply part for supplying the second wire to the winding part, wherein the supply part includes a height measuring part; a first pulley part including a movable pulley and a movable body; a bobbin part around which the second wire has been wound; a motor part for rotating the bobbin part; and a control part which controls the speed of the second wire supplied to the winding part by controlling the operation of the motor part.

4 Claims, 6 Drawing Sheets

(56) References Cited

U.S. PATENT DOCUMENTS

2016/0002003 A1* 1/2016 Fishbeck ..... H01F 41/073
242/559.1

* cited by examiner

APPARATUS FOR MANUFCTURING GUITAR STRING

CROSS-REFERENCE TO RELATED APPLICATION

This application claims priority to and the benefit of Korean Patent Application No. 10-2021-0072674 filed on Jun. 4, 2021, the disclosure of which is incorporated herein by reference in its entirety.

TECHNICAL FIELD

This disclosure relates to an apparatus for manufacturing a guitar string, and more particularly, to an apparatus for manufacturing a guitar string which is capable of uniformly winding a winding wire around on a core wire when manufacturing a wound string of guitar strings.

BACKGROUND

The guitar is one of the popular musical instruments in our lives. In general, guitar strings are classified into a wound string and a plain string. The wound string refers to one which is made by winding a wrap wire tightly around a core wire, and the plain wire refers to one including only a core wire without a wrap wire. In the case of a 6-string guitar, plain strings are usually used for the 1st and 2nd strings, and wound strings are used for the 3rd to 6th strings.

A metal steel wire such as a piano wire, or a strong synthetic fiber may be used as the core wire of the plain or wound string. An alloy wire made of copper and zinc may be usually used as the wrap wire, and an appropriate amount of phosphorus may be added to the alloy wire if necessary.

In order to manufacture a wound string, a process of winding a wrap wire around a core wire is essential. However, when the wrap wire is supplied to the core wire to wind the wrap wire around the core, if the tension applied to the wrap wire is not constant, the manufactured wound string may be defective or its sound quality may be deteriorated.

SUMMARY

An objective of this disclosure is to provide an apparatus for manufacturing a guitar string with improved sound quality.

Additionally, another objective of this disclosure is to provide an apparatus for manufacturing a guitar string capable of lowering the defective rate when manufacturing a guitar string.

Additionally, another objective of this disclosure is to provide an apparatus for manufacturing a guitar string capable of improving productivity.

According to an embodiment of this disclosure, an apparatus for manufacturing a guitar string includes a table part; a holding part which is installed on the table part and holds both ends of a first wire so that the first wire is rotatable; a winding part which is movable in a direction in which the first wire is extended, so that the winding part sequentially winds a second wire around on the outer surface of the first wire being rotated; and a supply part for supplying the second wire to the winding part, wherein the supply part includes a height measuring part; a first pulley part including a movable pulley around which at least a portion of the second wire is wound, and a movable body provided with a hole through which the height measuring part passes, and coupled with the movable pulley, wherein the movable body moves along a direction in which the height measuring part extends when the second wire starts to be wound around the first wire; a bobbin part around which the second wire has been wound, the bobbin part supplying the second wire to the movable pulley; a motor part for rotating the bobbin part; and a control part which controls the speed of the second wire supplied to the winding part by controlling the operation of the motor part, and which causes the motor part to rotate the bobbin part at a speed corresponding to height information of the movable body measured by the height measuring part.

Further, the movable body may be located at a first height before the second wire starts to be wound around the first wire, and may be moved to a second height higher than the first height when the second wire starts to be wound around the first wire by the movement of the winding part.

Additionally, while the second wire is wound around the first wire, the control part may control the rotation speed of the bobbin part by the motor part so that the movable body maintains a height within a preset error range with respect to the second height.

Additionally, the preset error range may be between −2 cm and +2 cm.

Additionally, when the operation of winding the second wire around the first wire is completed, the movable body gradually may descend from the second height.

Additionally, the supply part may include a second pulley part including a fixed pulley around which at least a portion of the second wire supplied to the winding part is wound, and the second wire may be supplied from the bobbin part to the winding part through the fixed pulley and the movable pulley in orderly sequence.

Additionally, the height measuring part may be in the form of a bar having magnetism, and measure at least any one of a height, a displacement, and a moving speed of the movable body through the magnetism.

Additionally, the control part may stop the operation of the motor part when the movable body moves out of a preset range from the second height while the second wire is wound around the first wire.

According to this disclosure, it is possible to provide an apparatus for manufacturing a guitar string with improved sound quality.

Additionally, according to this disclosure, it is possible to provide an apparatus for manufacturing a guitar string capable of lowering the defective rate when manufacturing a guitar string.

According to this disclosure, it is possible to provide an apparatus for manufacturing a guitar string capable of improving productivity.

BRIEF DESCRIPTION OF DRAWINGS

The above and other objects, features and advantages of the present invention will become more apparent to those skilled in the art by describing exemplary embodiments thereof in detail with reference to the accompanying drawings, in which.

DETAILED DESCRIPTION OF EXEMPLARY EMBODIMENTS

Figure 1:
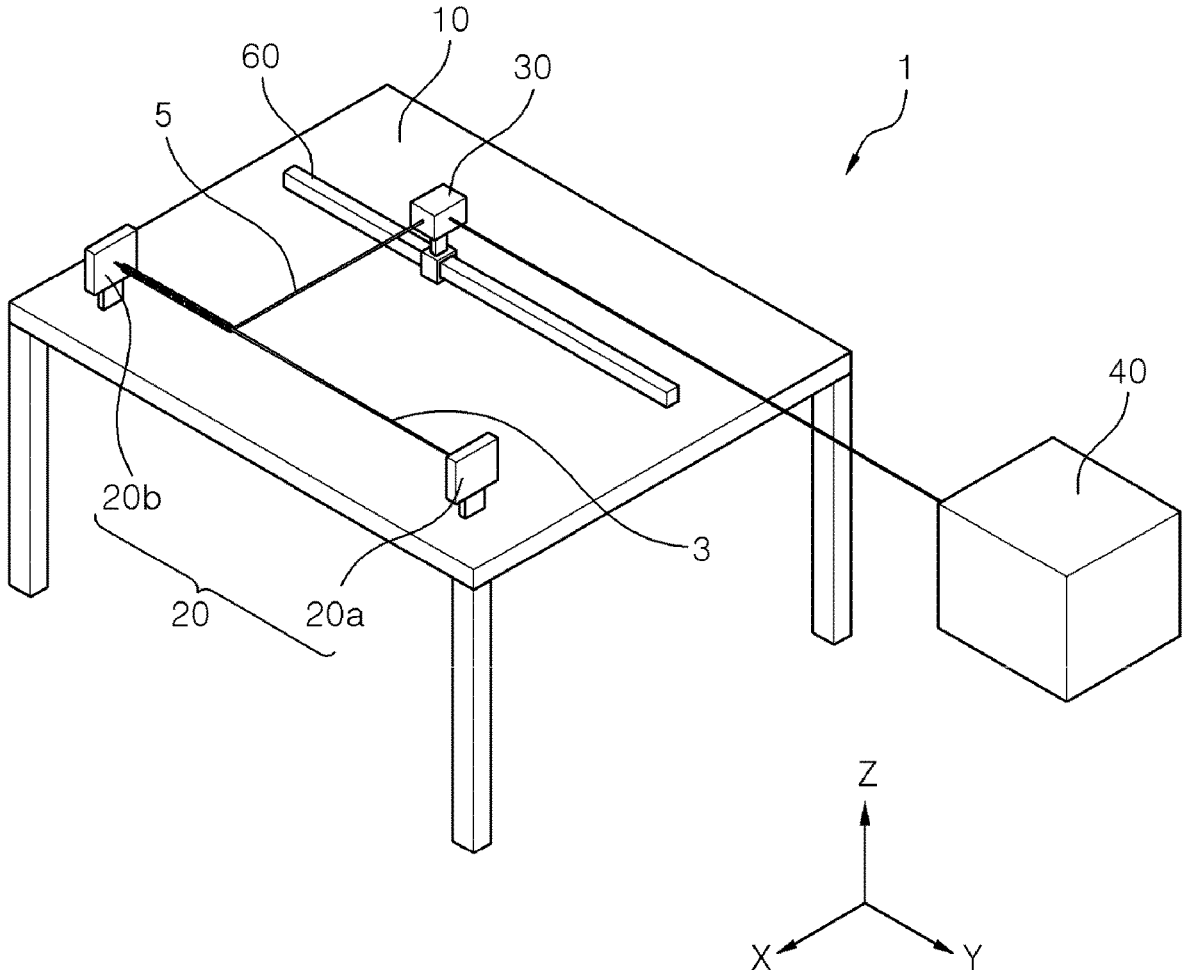
FIG. 1 is a diagram representing an apparatus for manufacturing a guitar string according to an embodiment of this disclosure.

Hereinafter, embodiments related to this disclosure, which are illustrated in the drawings, will be described specifically through detailed description. However, this disclosure is not limited to the embodiments disclosed below, but may be implemented in various different forms. It should be understood that this disclosure includes all modifications, equivalents, and substitutes included in the spirit and scope of this disclosure.

Terms, such as first, second, A, B, (a), and (b), may be used to describe various configuration elements. These terms are used only for the purpose of distinguishing one configuration element from another configuration element, and do not limit the essence, sequence, or order of the corresponding configuration elements. Additionally, when one configuration element is described herein as being "connected", "coupled" or "contacted" to another configuration element, the one configuration element may be directly connected to, coupled to, or contacted to the other configuration element, and, however, it should be understood that still another configuration element may be "connected", "coupled" or "contacted" therebetween. In the case of being "connected", "coupled" or "contacted", it may be understood as being physically "connected", "coupled" or "contacted" as well as being electrically "connected", "coupled" or "contacted" as needed.

The term, such as "~part (unit)", "~group", "~element", "~module", or the like, described in this specification refers to a unit for processing at least one function or operation, which may be embodied by hardware, software, or a combination of hardware and software. Additionally, in the present specification, the term, such as "include", "comprise", "have", or the like, is intended to designate existence of a corresponding configuration element, and thus should be construed as having the possibility of existence or addition of other configuration element without excluding it, unless expressly stated to the contrary.

And it should be noted that the classification of the configuration parts in the present specification is merely a division according to a main function which each configuration part is responsible for. That is, two or more configuration parts to be described below may be combined into one configuration part, or one configuration part may be divided into two or more configuration parts according to more subdivided functions. And each of the configuration parts to be described below may additionally perform some or all of the functions of other configuration elements in addition to the main function which it is responsible for, and of course, some of the main functions that each of the configuration parts is responsible for may be exclusively performed by another configuration part.

Hereinafter, with reference to the drawings related to embodiments of this disclosure, an apparatus for manufacturing a guitar string according to an embodiment of this disclosure will be described.

Figure 2:
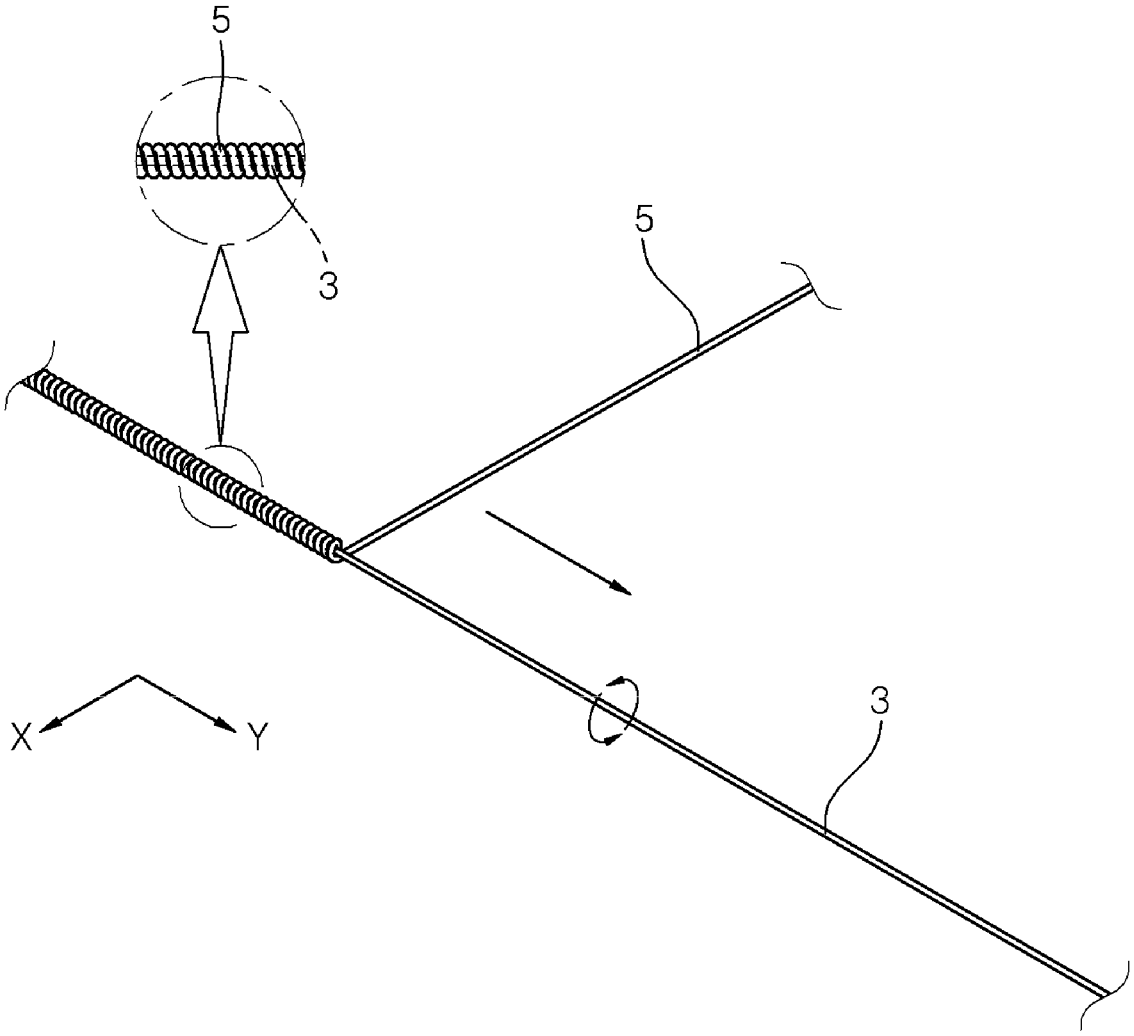
FIG. 2 is a diagram for explaining a method in which a second wire is wound around a first wire.

FIG. 1 is a diagram representing an apparatus for manufacturing a guitar string according to an embodiment of this disclosure, and FIG. 2 is a diagram for explaining a method in which a second wire is wound around a first wire.

Referring to FIG. 1, the apparatus 1 for manufacturing a guitar string according to an embodiment of this disclosure may include a table part 10, a holding part 20, a winding part 30, and a supply part 40.

The holding part 20 may be fixedly installed on the table part 10. In addition, a rail 60 for allowing the winding part 30 to move along the Y-axis direction may be installed on the table part 10.

The holding part 20 may be installed on the table part 10 to hold both ends of the first wire 3. Accordingly, the first wire 3 may be fixed to the holding part 20 while being spaced apart from the table part 10 by a predetermined distance.

The holding part 20 may include a first holding part 20*a* for holding one end of the first wire 3, and a second holding part 20*b* for holding the other end of the first wire 3, and the first holding part 20*a* and the second holding part 20*b* may be disposed to be spaced apart from each other.

The holding part 20 may rotate the first wire 3 with its both ends fixed to the holding part 20 while the second wire 5 is being wound around the first wire 3, and to this end, the holding part 20 may include a motor (not shown) for rotating the first wire 3.

Then, the winding part 30 is movable along the direction in which the first wire 3 is extended, that is, the Y-axis direction, and may wind the second wire 5 sequentially around on the outer surface of the first wire 3 while moving along the Y-axis direction.

For example, the winding part 30 may wind the second wire 5 around on the first wire 3 while moving along a direction from a position adjacent to the first holding part 20*a* to a position adjacent to the second holding part 20*b*. However, this disclosure is not limited thereto, and the winding part 30 may wind the second wire 5 around on the first wire 3 while moving along a direction from the second holding part 20*b* to the first holding part 20*a*.

Here, the first wire 3 may be a core wire of a wound string, and the second wire 5 may be a winding wire of the wound string.

In order to manufacture the wound string among guitar strings, the process of winding the second wire 5, which is the winding wire, around on the first wire 3, which is the core wire, need to be performed, and as shown in FIG. 2, while the first wire 3 rotates in one direction as the second wire 5 moves at a constant speed from one end to the other end of the first wire 3 by the winding part 30, the second wire can wrap around the outer surface of the first wire 3.

Then, the supply part 40 may supply the second wire 5 to the winding part 30. Additionally, the supply part 40 may control the tension of the second wire 5 to be constant while supplying the second wire 5 so that the second wire 5 is wound around the first wire 3.

On the other hand, although not shown in the drawings, the table part 10 may be provided with a cutting part, which may perform a function of cutting off by applying a force to the other end of the first wire 3 on which the second wire 5 has been wound. To this end, the cutting part may be positioned adjacent to the second holding part 20*b*. However, in order to correspond to the various lengths of guitar strings, the cutting part may move in the Y-axis direction along a rail (not shown) installed on the table part.

Figure 3:
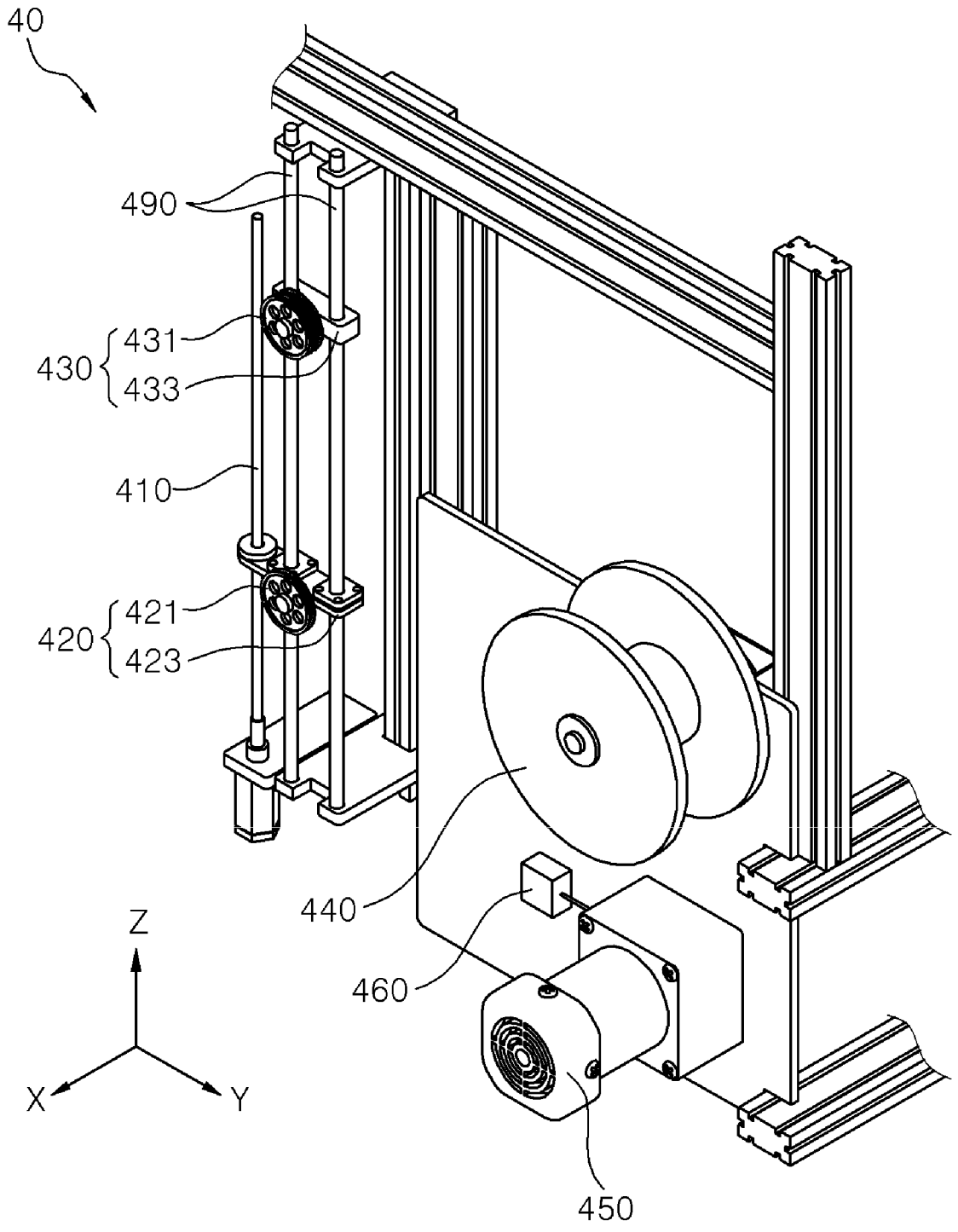
FIG. 3 is a diagram specifically showing the configuration of the supply part according to an embodiment of this disclosure.

FIG. 3 is a diagram specifically showing the configuration of the supply part according to an embodiment of this disclosure.

Referring to FIG. 3, the supply part 40 according to the embodiment of this disclosure may include a height measuring part 410, a first pulley part 420, a second pulley part 430, a bobbin part 440, and a motor part 450, and a control part 460.

The height measuring part 410 may sense the height of the first pulley part 420, and more specifically, it may sense the height and/or displacement of a movable body 423 included in the first pulley part 420. The height measuring part 410 may be in the form of a bar having the magnetism.

Then, the first pulley part 420 may include a movable pulley 421 and the movable body 423.

The movable pulley 421 may be located on one side of the movable body 423, and at least a portion of the second wire 5 to be supplied to the winding part 30 may be wound or hung on the movable pulley 421.

The movable body 423 may move in the Z-axis direction (hereinafter, referred to as a 'third direction') along support columns 490. The support columns 490 guide the movable body 423 so that the movable body can move in the third direction, while preventing it from moving in the X-axis direction or the Y-axis direction. For this, at least two support columns 490 may be provided parallel to each other.

The movable body 423 may include a hole through which the support column 490 passes, and a hole through which the height measuring part 410 passes. Here, the size of the hole through which the height measuring part 410 passes may be formed to be larger than the width of the height measuring part 410, so that the movable body 423 and the height measuring part 410 do not cause friction with each other when the movable body 423 moves in the third direction.

Additionally, the movable body 423 may include iron (Fe), so that the height measuring part 410 having magnetism can sense the position, displacement, and moving speed of the movable body 423.

Next, the second pulley part 430 may include a fixed pulley 431 and a fixed body 433.

The fixed pulley 431 is located on one side of the fixed body 433, and at least a portion of the second wire 5 to be supplied to the winding part 30 may be wound or hung on the fixed pulley 431.

The fixed body 433 may include a hole through which the support column 490 passes, and may be fixed to the support column 490. That is, the position (or height) of the fixed body 433 is fixed and does not change, and the fixed body may not move along the third direction, unlike the movable body 423.

Next, the second wire 5 is wound a plurality of times around the bobbin part 440, which may supply the second wire 5 to the first pulley part 420 and the second pulley part 430, so that the second wire 5 can be supplied to the winding part 30 through the first pulley part 420 and the second pulley part 430.

Further, the motor part 450 may rotate the bobbin part 440. As the bobbin part 440 is rotated by the motor, the second wire 5 wound around the bobbin part 440 may be unwound and move toward the first pulley part 420 and the second pulley part 430. For example, the motor part 450 may include an inverter motor.

Finally, the control part 460 may control the operation of the motor part 450. Specifically, the control part 460 may adjust the rotation speed of the bobbin part 440 and the supply speed of the second wire 5 by controlling the operation of the motor part 450.

Although the control part 460 and the motor part 450 are shown in the drawings as being configured separately from each other, this disclosure is not limited thereto, but the control part 460 may be provided inside the motor part 450 to be integrally formed with the motor part 450.

Figure 4:
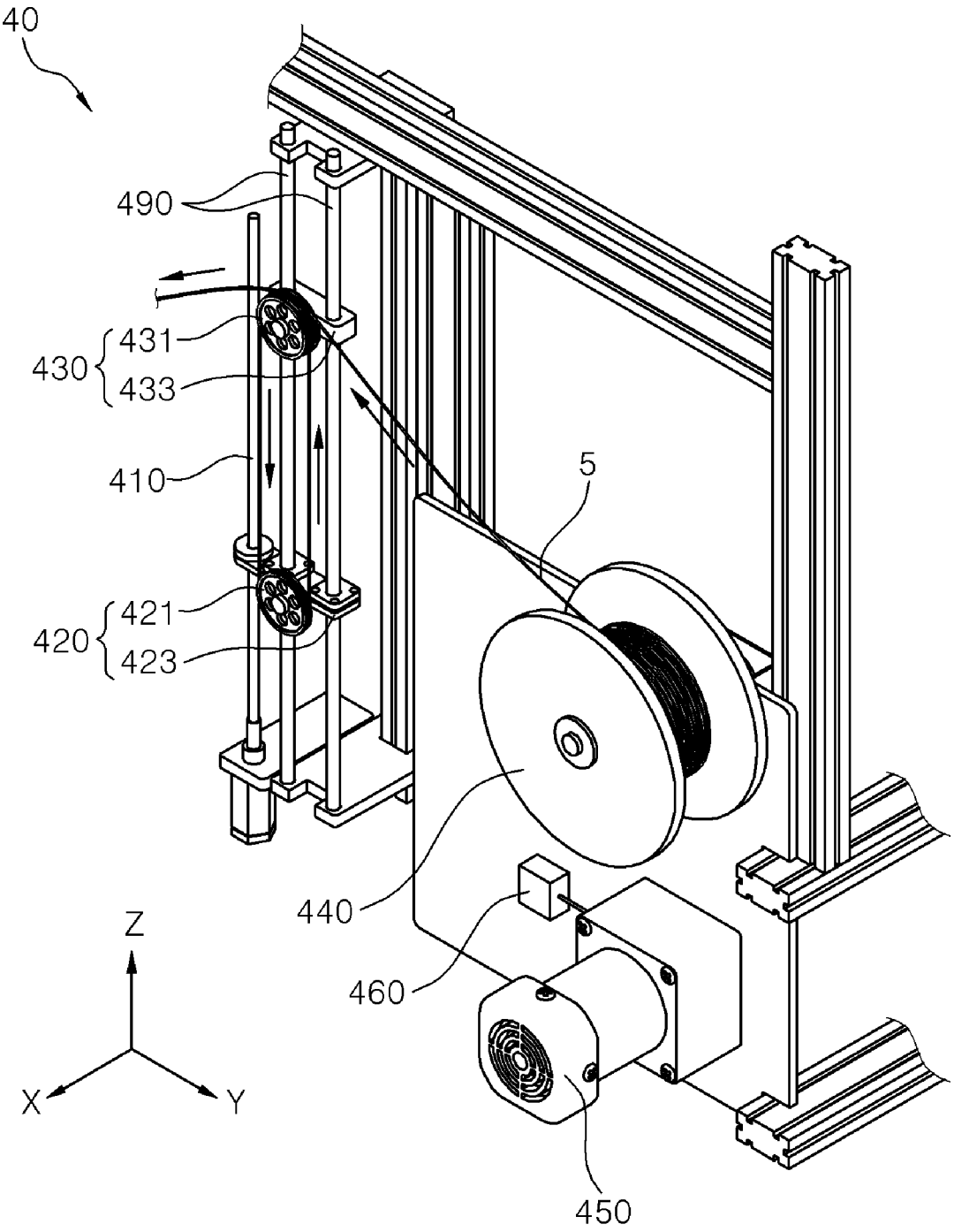
FIG. 4 is a diagram showing the supply part shown in FIG. 3 with the second wire connected thereto.

FIG. 4 is a diagram showing the supply part shown in FIG. 3 with the second wire connected thereto.

Referring to FIG. 4, the second wire 5 is first supplied from the bobbin part 440, is wound around the movable pulley 421 via the fixed pulley 431, and then passed through the fixed pulley 431 again, and connected to the winding part 30. However, this disclosure is not limited thereto, but the traveling direction of the second wire 5 from the bobbin part 440 to the winding part 30 may be variously changed.

Hereinafter, a method of driving the supply part 40 when the second wire 5 is wound around the first wire 3 will be described with reference to FIGS. 3 to 5.

Figure 5:
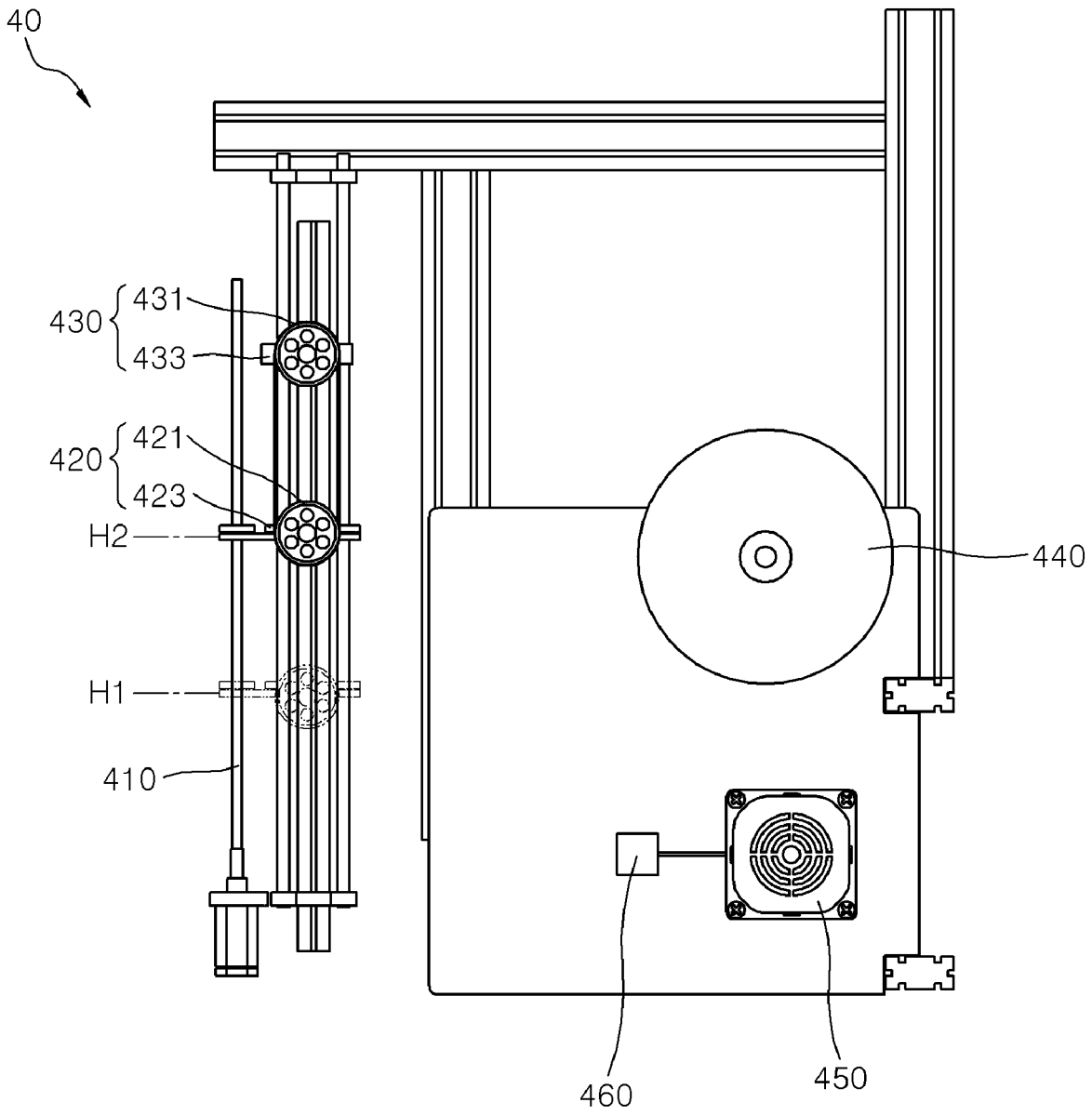
FIG. 5 is a diagram showing a state in which the movable body according to an embodiment of this disclosure is moved from a first height.

FIG. 5 is a diagram showing a state in which the movable body according to an embodiment of this disclosure is moved from a first height.

Referring to FIG. 3, before winding the second wire 5 around the first wire 3, the movable body 423 may be positioned at the first height H1.

After that, when the operation of winding the second wire 5 around the first wire 3 is initiated, the winding part 30 moves to the position adjacent to the second holding part 20*b*, and as shown in FIG. 5, by the pulling force of the second wire 5 supplied from the winding part 30 to the first wire 5, the movable body 423 can be moved to the position of the second height H2. In this connection, the second height H2 may be higher than the first height H1.

While the second wire 5 is wound around the first wire 3, the movable body 423 may maintain a height within a preset first error range with respect to the second height H2. For example, when the first error range is set to ±2 cm, the movable body 423 may be controlled to be located in a range between a height 2 cm higher than the second height H2 and a height 2 cm lower than the second height H2.

When the operation of winding the second wire 5 around the first wire 3 is completed, the movable body 423 can descend, for example, be moved back to the first height H1 at a lower speed than when ascending from the first height H1 to the second height H2, but this disclosure is not limited thereto.

Whether the movable body 423 has moved to the second height H2 when the operation of winding the second wire 5 around the first wire 3 is started, whether the movable body 423 maintains a height equal to or similar to the second height H2 while the second wire 5 is wound around the first wire 3, whether the operation of winding the second wire 5 around the first wire 3 is completed and the movable body 423 returns to the position of the first height H1, or the like may be sensed by the height measuring part 410.

The control part 460 according to an embodiment of this disclosure may control the motor part 450 and thus the rotation speed of the bobbin part 440, such that while the second wire 5 is wound, the height of the movable body 423 may be maintained within the first error range with respect to the second height H2.

Meanwhile, when it is sensed by the height measuring part 410 that the height of the movable body 423 is out of a preset second error range with respect to the second height H2, the operation of winding the second wire 5 around the first wire 3 may be stopped.

That is, the control part 460 stops the driving of the motor part 450 and thus the rotation of the bobbin part 440, so that the second wire 5 is no longer supplied to the winding part 30.

According to an embodiment of this disclosure, since the rotation speeds of the motor part 450 and thus the bobbin part 440 are controlled such that the movable body 423 can be maintained at the same or similar height as the second height H2 while the second wire 5 is wound around the first wire 3, the second wire 5 can be uniformly wound around the first wire 3 from the time when the second wire 5 starts to be wound around the first wire 3 until the time when winding operation is finished.

That is, with the supply part 40 according to the embodiment of this disclosure capable of providing a uniform tension to the second wire 5 while the second wire 5 is wound around the first wire 3, it is possible to manufacture guitar strings with improved sound quality.

Meanwhile, when the movable body 423 moves from the first height H1 to the second height H2, it moves at a high speed, while when it returns to the first height H1 from the second height H2 after the winding operation is completed, it may move at a relatively slow speed.

According to the embodiment of this disclosure, the second height H2 may be changed according to the width of the second wire 5. For example, the width of the second wire 5 may be 0.12 mm to 0.65 mm, and as the width of the second wire 5 is smaller, the second height H2 may be lowered. Further, as the second height H2 is lower, the speed at which the second wire 5 is wound around the first wire 3 may be slower. In this case, the control part 460 may control the operation of the motor part 450 so that the bobbin part 440 can rotate at a speed corresponding to the second height H2.

The smaller the width of the second wire 5 is, the more densely the second wire 5 must be wound around the first wire 3 at a low winding speed, and thus the second height H2 may be low to provide a relatively small magnitude of tension.

Figure 6:
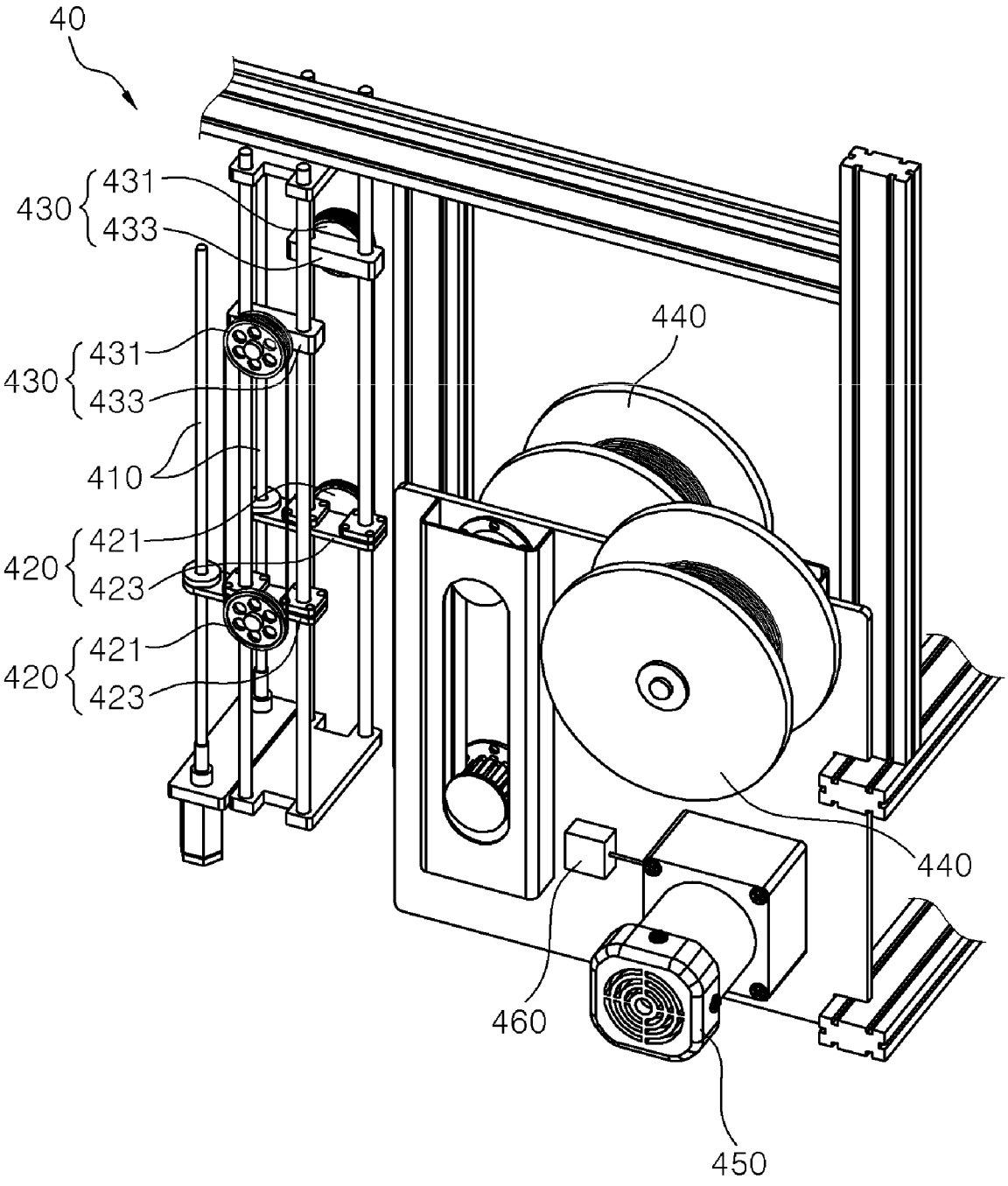
FIG. 6 is a diagram showing a supply part according to another embodiment of this disclosure.

FIG. 6 is a diagram showing a supply part according to another embodiment of this disclosure. In describing the supply part according to another embodiment of this disclosure, the same reference numerals are given to the same components as those of the embodiment described with reference to FIGS. 1 to 5, and the description of the content overlapping with the above-described embodiment will be omitted while the differences therebetween will be mainly discussed in detail.

Referring to FIG. 6, the apparatus for manufacturing a guitar string according to another embodiment of this disclosure may include a plurality of supply parts 40. That is, it may be provided with a plurality of the height measuring parts 410, a plurality of the first pulley parts 420, a plurality of the second pulley parts 430, a plurality of the bobbin parts 440, a plurality of the motor parts 450, and a plurality of the control parts 460. For example, as shown in FIG. 6, it may be provided with at least two height measuring parts 410, at least two first pulley parts 420, at least two second pulley parts 430, at least two the bobbin parts 440, at least two motor parts 450, and at least two control parts 460.

In this case, the height measurement part 410, the first pulley part 420, the second pulley part 430, the bobbin part 440, the motor part 450 and the control part 460 which are included in any one of the supply parts and form a connection relationship may be located on the front side, and the rest components may be located on the back side.

Although not shown in the drawing, when a plurality of supply parts 40 are provided, the table part 10 may be provided with the same number of holding parts 20 and winding parts 30 as the number of supplied supply parts 40.

In this regard, the surface on which the holding part 20 receiving the second wire 5 from any one of the supply parts 40 is fixedly installed, and the surface on which the holding part 20 receiving the second wire 5 from the other one of the supply parts 40 is fixedly installed may be located at different heights.

According to another embodiment of this disclosure, since a plurality of guitar strings can be manufactured at the same time, there is an advantage in that productivity is further improved.

Those of ordinary skill in the art to which this disclosure pertains will understand that this disclosure may be embodied in other specific forms without changing the technical spirit or essential features thereof. Therefore, the embodiments described above should not be construed as limiting but rather as illustrative in every respect. The scope of the disclosure is defined by the following claims rather than the detailed description, and all modifications derived from the meaning and scope of the claims and equivalents thereto or modified forms should be interpreted as being included in the scope of the disclosure.

Reference Sign List

1: Apparatus for manufacturing a guitar string
3: First wire
5: Second wire
10: Table part
20: Holding part
30: Winding part
40: Supply part
410: Height measuring part
420: First pulley part
421: Movable pulley
423: Movable body
430: Second pulley part
431: Fixed pulley
433: Fixed body
440: Bobbin part
450: Motor part
460: Control part
490: Support column

What is claimed is:

1. An apparatus for manufacturing a guitar string, the apparatus comprising:

a table part;

a holding part which is installed on the table part and holds both ends of a first wire so that the first wire is rotatable;

a winding part which is movable in a direction in which the first wire is extended, so that the winding part sequentially winds a second wire around on the outer surface of the first wire being rotated; and a supply part for supplying the second wire to the winding part, wherein the supply part includes:

a height measuring part;

a first pulley part including a movable pulley around which at least a portion of the second wire is wound, and a movable body provided with a hole through which the height measuring part passes, and coupled with the movable pulley, wherein the movable body moves along a direction in which the height measuring part extends when the second wire starts to be wound around the first wire;

a bobbin part around which the second wire has been wound, the bobbin part supplying the second wire to the movable pulley;

a motor part for rotating the bobbin part; and a control part which controls the speed of the second wire supplied to the winding part by controlling the operation of the motor part, and which causes the motor part to rotate the bobbin part at a speed corresponding to height information of the movable body measured by the height measuring part, wherein the height measuring part senses at least any one of the height and displacement of the movable body, and is formed in a bar shape having magnetism, wherein the movable body is located at a first height before the second wire starts to be wound around the first wire, and is moved to a second height higher than the first height when the second wire starts to be wound around the first wire by the movement of the winding part, and wherein the smaller the width of the second wire is, the lower the second height is set.

2. The apparatus of claim 1, wherein while the second wire is wound around the first wire, the control part controls the rotation speed of the bobbin part by the motor part so that the movable body maintains a height within a preset error range with respect to the second height.

3. The apparatus of claim 2, wherein the preset error range is between −2 cm and +2 cm.

4. The apparatus of claim 2, wherein when the operation of winding the second wire around the first wire is completed, the movable body gradually descends from the second height.

* * * * *